US008128196B2

(12) United States Patent
Garbacz et al.

(10) Patent No.: US 8,128,196 B2
(45) Date of Patent: Mar. 6, 2012

(54) THERMAL CLEANING OF INDIVIDUAL JETTING MODULE NOZZLES

(75) Inventors: Gregory J. Garbacz, Rochester, NY (US); Ali G. Lopez, Pittsford, NY (US); Chang-Fang Hsu, Beavercreek, OH (US)

(73) Assignee: Eastman Kodak Company, Rochester, NY (US)

( * ) Notice: Subject to any disclaimer, the term of this patent is extended or adjusted under 35 U.S.C. 154(b) by 491 days.

(21) Appl. No.: 12/333,338

(22) Filed: Dec. 12, 2008

(65) Prior Publication Data

US 2010/0149238 A1 Jun. 17, 2010

(51) Int. Cl.
*B41J 23/00* (2006.01)

(52) U.S. Cl. ..... 347/35

(58) Field of Classification Search ..... 347/10, 347/20, 21, 22, 26, 28, 35, 40, 56
See application file for complete search history.

(56) References Cited

U.S. PATENT DOCUMENTS

| | | | | |
|---|---|---|---|---|
| 4,296,418 | A | 10/1981 | Yamazaki et al. | |
| 4,928,115 | A | 5/1990 | Fagerquist et al. | |
| 4,970,535 | A | 11/1990 | Oswald et al. | |
| 5,412,411 | A | 5/1995 | Anderson | |
| 5,455,608 | A * | 10/1995 | Stewart et al. | 347/23 |
| 5,475,410 | A | 12/1995 | Durst et al. | |
| 5,557,307 | A | 9/1996 | Paroff | |
| 5,751,307 | A | 5/1998 | Paroff et al. | |
| 5,847,674 | A | 12/1998 | Paroff et al. | |
| 5,877,788 | A | 3/1999 | Haan et al. | |
| 6,079,821 | A | 6/2000 | Chwalek et al. | |
| 6,183,057 | B1 | 2/2001 | Sharma et al. | |
| 6,196,657 | B1 | 3/2001 | Hawkins et al. | |
| 6,247,781 | B1 | 6/2001 | Blum | |
| 6,273,103 | B1 | 8/2001 | Enz et al. | |
| 6,280,023 | B1 | 8/2001 | Ufkes | |
| 6,457,807 | B1 | 10/2002 | Hawkins et al. | |
| 6,491,362 | B1 | 12/2002 | Jeanmaire | |
| 6,505,921 | B2 | 1/2003 | Chwalek et al. | |
| 6,517,197 | B2 * | 2/2003 | Hawkins et al. | 347/74 |
| 6,554,410 | B2 | 4/2003 | Jeanmaire et al. | |
| 6,575,566 | B1 | 6/2003 | Jeanmaire et al. | |
| 6,588,888 | B2 | 7/2003 | Jeanmaire et al. | |
| 6,793,328 | B2 | 9/2004 | Jeanmaire | |

(Continued)

FOREIGN PATENT DOCUMENTS

| | | |
|---|---|---|
| EP | 0 218 686 | 8/1990 |
| EP | 0 911 171 | 4/1999 |

OTHER PUBLICATIONS

Japan Abstract No. 04-039055, Oct. 2, 1992.

*Primary Examiner* — Stephen Meier
*Assistant Examiner* — Tracey McMillion
(74) *Attorney, Agent, or Firm* — William R. Zimmerli

(57) ABSTRACT

A liquid ejection device includes a jetting module including an array of nozzles; a thermal stimulation device associated with each nozzle of the array of nozzles; and a controller in electrical communication with each thermal stimulation device. The controller is configured to provide a first activation waveform to each thermal stimulation device and to provide a second activation waveform to each thermal stimulation device to clean the associated nozzle with liquid emitted from the associated nozzle. The second activation waveform has a higher activation component when compared to the first activation waveform.

13 Claims, 6 Drawing Sheets

U.S. PATENT DOCUMENTS 6,802,588 B2 10/2004 Garbacz et al.
6,827,429 B2 12/2004 Jeanmaire et al.
6,848,766 B2 2/2005 Garbacz et al.
6,851,796 B2 2/2005 Jeanmaire et al.
6,869,160 B2 3/2005 West et al.
7,198,351 B2 * 4/2007 Wang et al. ..... 347/28
7,604,321 B2 * 10/2009 Sheahan et al. ..... 347/26

* cited by examiner

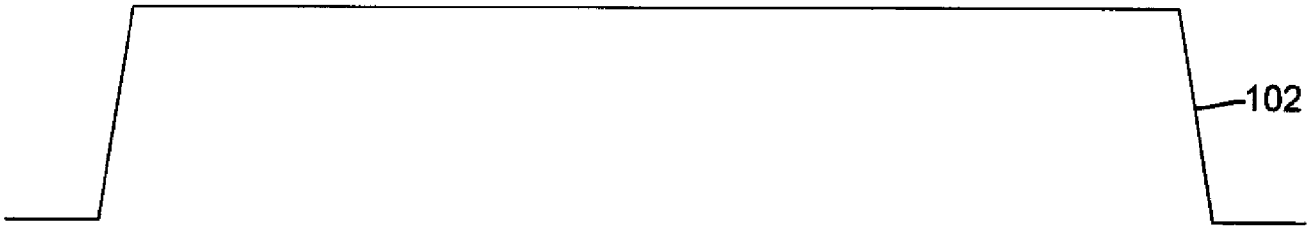
FIG. 4G
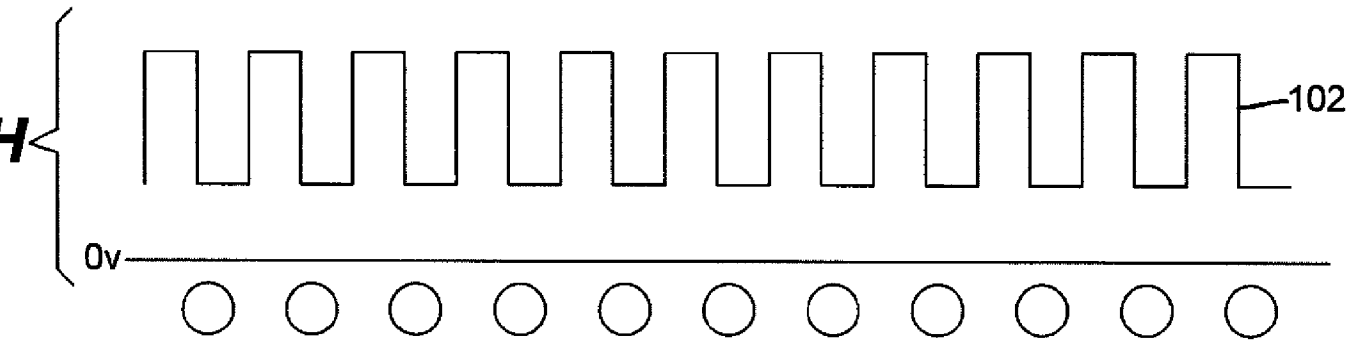
FIG. 4H
FIG. 6

THERMAL CLEANING OF INDIVIDUAL JETTING MODULE NOZZLES

CROSS REFERENCE TO RELATED APPLICATIONS

Reference is made to commonly-assigned, U.S. patent application Ser. No. 12/333,340, entitled "PRESSURE MODULATION CLEANING OF JETTING MODULE NOZZLES", filed concurrently herewith.

FIELD OF THE INVENTION

This invention relates generally to the field of digitally controlled printing devices, and in particular to techniques for cleaning individual nozzles of a jetting module.

BACKGROUND OF THE INVENTION

Debris, for example, dust or dirt, when present in or around nozzles of a printhead can cause ink drops ejected from the nozzle to be misdirected or have inconsistencies in drop size or drop shape which may result in reduced print quality. Various techniques for removing debris located in or around the nozzles of a printhead are known and include, for example, utilizing a cleaning fluid and/or a mechanical cleaning assembly to clean the nozzles of the printhead.

SUMMARY OF THE INVENTION

According to one aspect of the present invention, a liquid ejection device includes a jetting module including an array of nozzles, a thermal stimulation device associated with each nozzle of the array of nozzles, and a controller in electrical communication with each thermal stimulation device. The controller is configured to provide a first activation waveform to each thermal stimulation device and to provide a second activation waveform to each thermal stimulation device to clean the associated nozzle with liquid emitted from the associated nozzle. The second activation waveform has a higher activation component when compared to the first activation waveform.

According to another aspect of the invention, a method of cleaning a liquid ejection device includes providing a jetting module including an array of nozzles; providing a thermal stimulation device associated with each nozzle of the array of nozzles; using a controller in electrical communication with each thermal stimulation device to provide a first activation waveform to each thermal stimulation device; and using the controller to provide a second activation waveform to each thermal stimulation device to clean the associated nozzle with liquid emitted from the associated nozzle, the second activation waveform having a higher activation component when compared to the first activation waveform.

BRIEF DESCRIPTION OF THE DRAWINGS

In the detailed description of the preferred embodiments of the invention presented below, reference is made to the accompanying drawings, in which:

FIGS. 4A-4H show example embodiments of heater activation waveforms and the resulting drop formation that occurs when the waveforms are used to activate drop forming heaters, in which:

FIG. 4A is a multi-burst heater-activating pulse waveform for activating drop forming heaters at a typical voltage, frequency, and pulse shape that produces small drops;

FIG. 4B is a multi-burst heater-activating pulse waveform for activating drop forming heaters with an electrical waveform to produce large and small drops for printing;

FIG. 4C is a multi-burst heater-activating pulse waveform for activating drop forming heaters with an electrical waveform with bursted pulses to generate large and small drops for printing;

FIG. 4D is a multi-burst heater-activating pulse waveform for activating drop forming heaters at an increased frequency without inducing drop break-off;

FIG. 4E is a multi-burst heater-activating pulse waveform for activating drop forming heaters at an increased voltage;

FIG. 4F is a multi-burst heater-activating pulse waveform for activating drop forming heaters with an increased duty cycle;

FIG. 4G is a direct current waveform for activating drop forming heaters without activation pulses; and FIG. 4H is a direct current waveform for activating drop forming heaters with activation pulses.

DETAILED DESCRIPTION OF THE INVENTION

Figure 1:
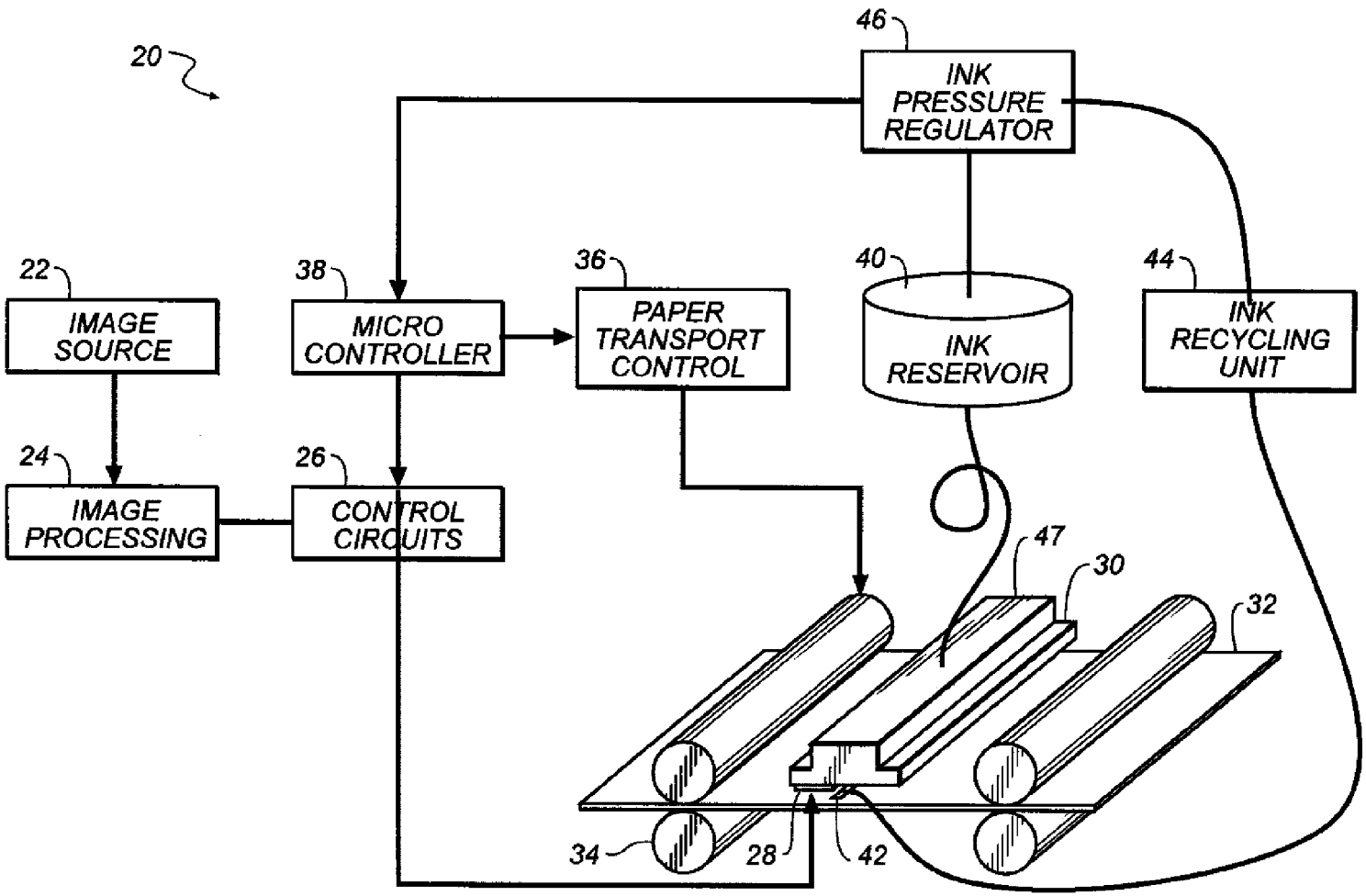
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead and/or printhead components typically used in inkjet printing systems. However, many other applications are emerging which use inkjet printheads to emit liquids (other than inks) that need to be finely metered and deposited with high spatial precision. As such, as described herein, the terms "liquid" and/or "ink" refer to any material that can be ejected by the printhead and/or printhead components described below.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26, often referred to as a controller, read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. As shown in FIG. 1, catcher 42 is a type of catcher commonly referred to as a "knife edge" catcher.

The ink is distributed to printhead 30 through an ink channel 47. The ink preferably flows through slots and/or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
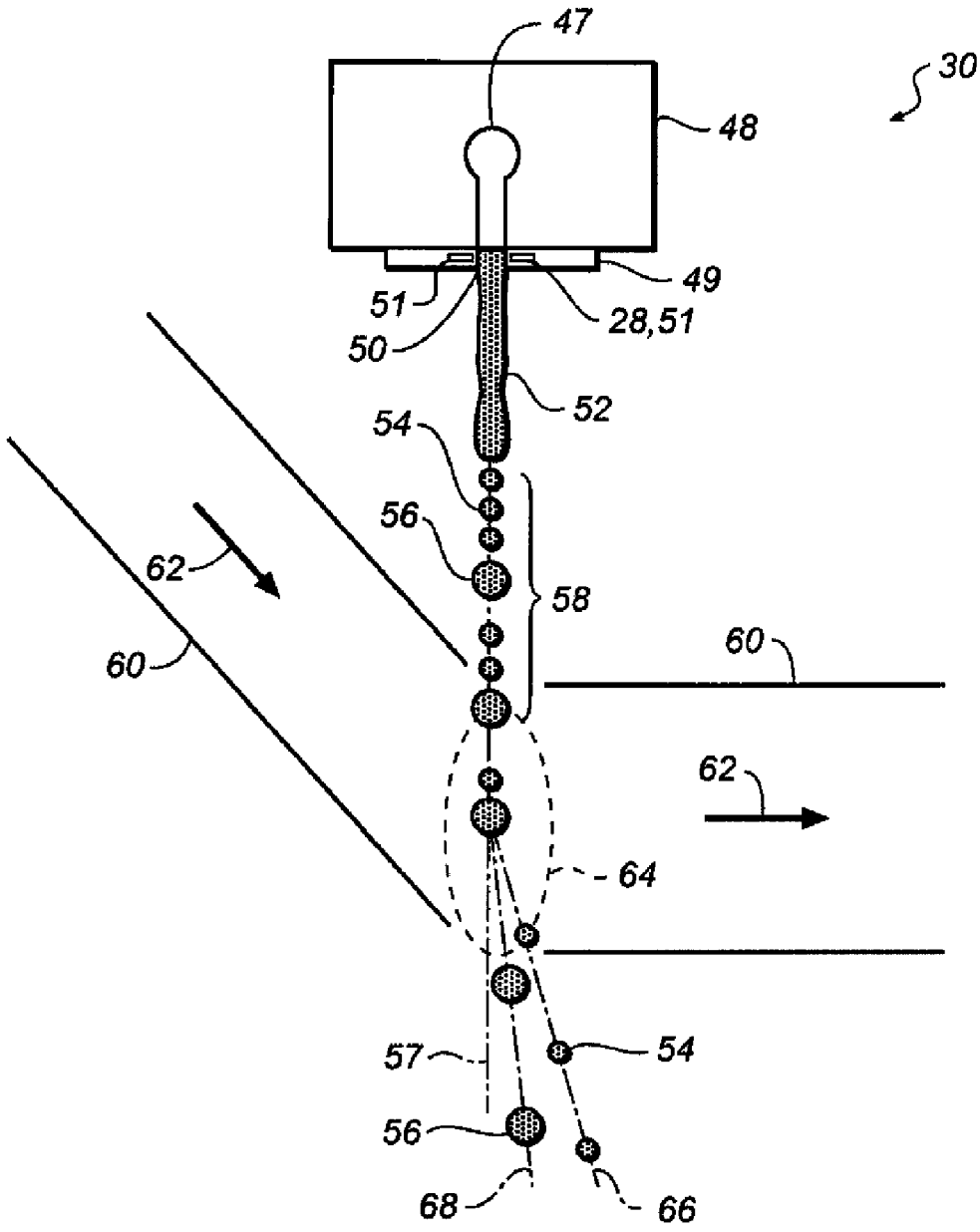
FIG. 2 is a schematic view of an example embodiment of a continuous printhead made in accordance with the present invention.
Figure 3:
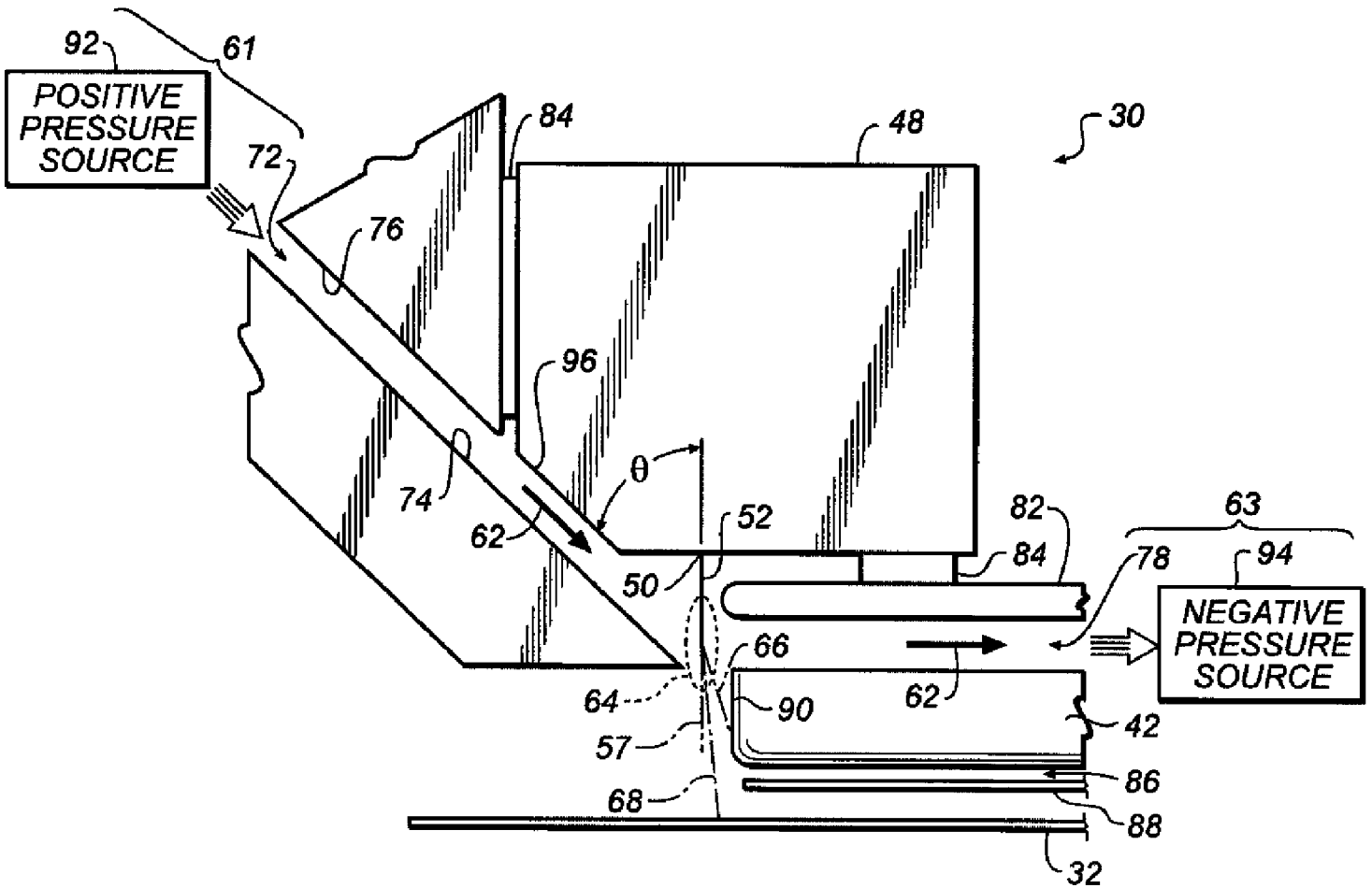
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to breakoff from the filament and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005, the disclosures of which are incorporated by reference herein.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

Alternatively, deflection can be accomplished by applying heat asymmetrically to filament of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821, issued to Chwalek et al., on Jun. 27, 2000.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Referring to FIGS. 4A-4H, controller 26 provides a first activation waveform to each thermal stimulation device, for example, heater 51, during normal printing operation. The time duration and the corresponding energy level for optimal operation depend on the geometry and thermal properties of the nozzles, the pressure applied to the ink, and the thermal properties of the ink. The particular energy level depends on the specific application contemplated. The controller 26 can be a relatively complex device (logic controller, programmable microprocessor, etc.) or a relatively simple device (a power supply for the heaters or a simple wave form generator).

Figure 4A:
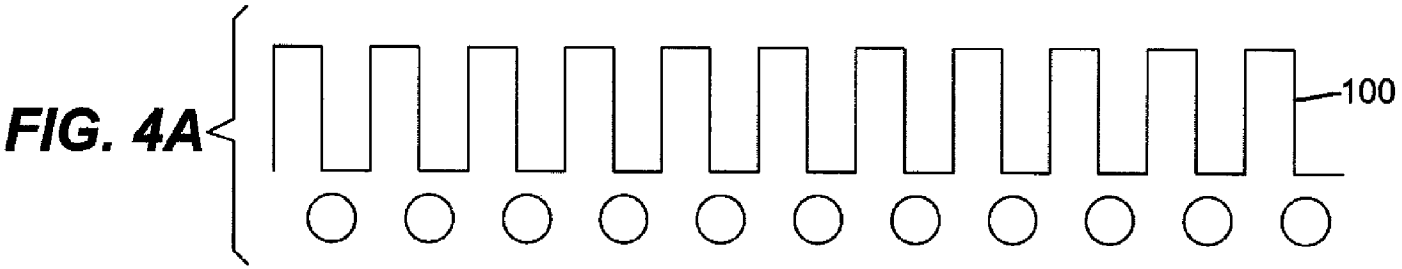
Figure 4B:
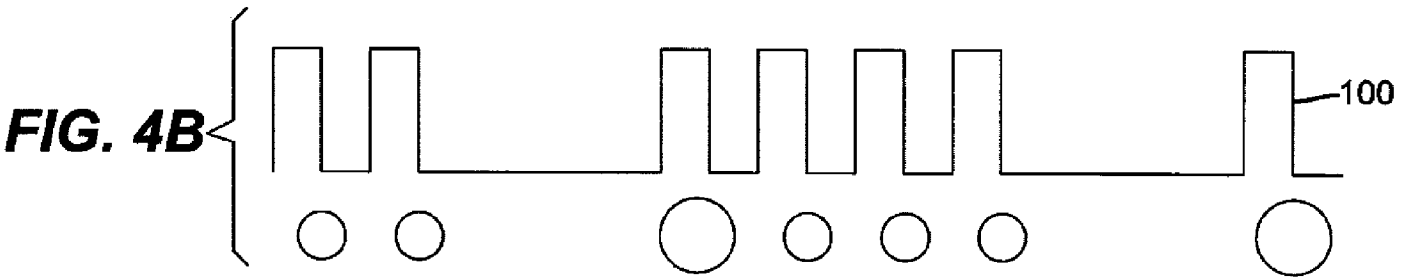
Figure 4C:
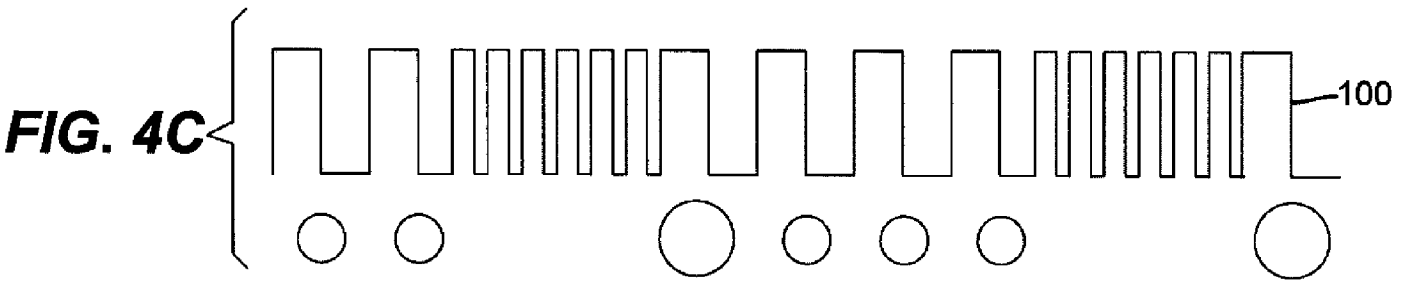

Referring to FIGS. 4A and 4B, example embodiments of a first electrical activation waveform 100 provided by controller 26 to one or more of heaters 51 for use in printing and resulting drops are shown. The waveform generates drops, both large and small, for use in printing operations. The total energy applied to the heater 51 is the total of energy pulses given in one specific time interval. Generally, a high frequency of the activation of heater results in smaller sized drops when compared to a low frequency activation. So, a low frequency in the activation of the heaters results in large volume drops, while a high frequency in the activation of the heaters results in small volume drops. In FIG. 4C, first activation waveform 100 is a multi-burst heater activating pulse waveform. One or more drop forming heaters are activated using an electrical waveform with bursted pulses to generate large and small drops for use in printing.

Controller 26 is also configured to provide a second activation waveform 102 to each thermal stimulation device, for example, heater 51. The second activation waveform 102 functions to clean the nozzle associated with each thermal stimulation device, or heater, with the liquid emitted through the nozzle. When the second activation waveform form is used for cleaning, the set of pulses has a larger activation component than is employed for drop formation. Additionally, the second activation waveform can be sized to cause stream deflection when applied to one of the two heater sections of heater 51 when heater 51 is an asymmetric heater. The controller 26 can be configured to provide the second activation waveform 102 to individual thermal stimulation devices, for example, to a thermal stimulation device associated with a nozzle that has been identified as not functioning properly. Example embodiments of the second activation waveform 102 are described below with reference to FIGS. 4D-4H.

The second activation waveform 102 used for cleaning has at least one activation component (frequency, amplitude, duty cycle, etc.) that is higher than the corresponding activation component of the first activation waveform used while printing. As used herein, the term activation component is defined to be at least one of a frequency, an amplitude, a duty cycle (ratio of pulse width to period) of the activation waveform, and a steady state voltage level. The steady state voltage level includes, for example, DC offset with activation pulses (as shown in FIG. 4H) and DC offset without activation pulses (as shown in FIG. 4G).

Figure 4D:
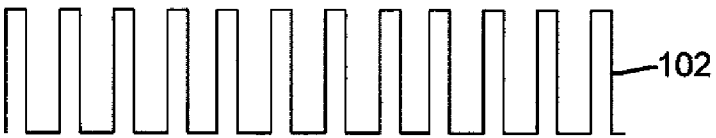

Referring to FIG. 4D, an example embodiment of a second activation waveform 102 is shown. The second activation waveform includes a set of pulses that are applied to one or more of heaters 51 at a frequency that is higher than the frequency used for printing. As shown in FIG. 4D, the increased pulse frequency is sufficiently high so that the pulses don't induce drop breakoff. Each activation pulse creates a perturbation to the jet diameter. When the spacing along the liquid stream between perturbations is less than π times the diameter of the jet, the perturbations don't grow to induce drop breakup but instead will decay away. Typically, this second activation waveform, when used for nozzle cleaning, is applied for a duration of at least one second, preferably for more than 5 seconds and, even more preferably for more than 15 seconds. Typically, the second activation waveform is applied for less than 200 seconds to reduce the likelihood of premature failure of the heaters. Alternatively, the increased pulse frequency can produce drops that are smaller then the small volume drops formed during printing. When formed, these drops are collected by catcher 42.

Figure 4E:
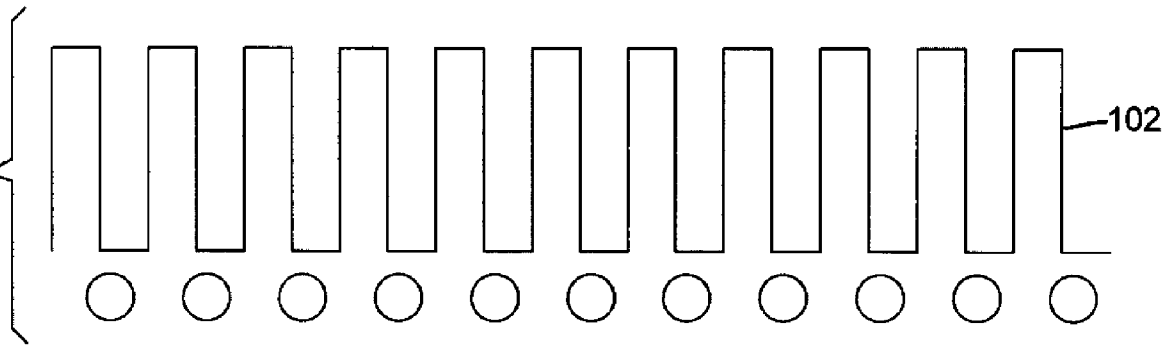

Referring to FIG. 4E, another example embodiment of second activation waveform 102 is shown. In this embodiment, the increased activation component is voltage amplitude. The increase in energy from the additional voltage applied to the heater 51 results in an increase of the temperature of the immediate surface of the printhead 30 surrounding nozzle 50 which increases the temperature of the fluid ejected from the nozzle and increases the temperature of the fluid meniscus around the nozzle. Typically, second activation waveform, when used for nozzle cleaning, is provided by the controller to the thermal stimulation device for a duration of at least one second, preferably for more than 5 seconds and even more preferably for more than 15 seconds. Typically, the second activation waveform is applied for less than 200 seconds to reduce the likelihood of premature failure of the heaters.

Figure 4F:
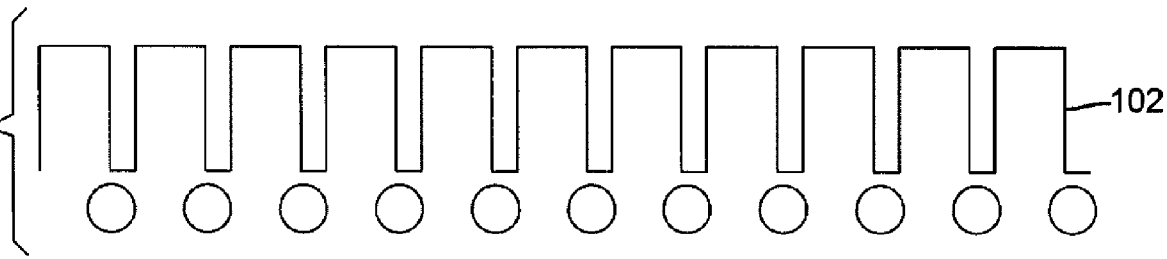

Referring to FIG. 4F, another example embodiment of second activation waveform 102 is shown. The activation component increased in this embodiment is duty cycle. Duty cycle is the ratio of the activation pulse width to the activation pulse period. This corresponds to the fraction of time that the power is supplied to the thermal stimulation device. Increasing the duty cycle, increases the average power supplied to the thermal stimulation device which increases the temperature of the immediate surface of the printhead 30 surrounding the nozzle 50 and increases the temperature of the fluid ejected from the nozzle and increases the temperature of the fluid meniscus around the nozzle. The resulting drops are also shown in FIG. 4F. For effective cleaning, the set of activation pulses with an increased duty cycle should be applied for at least one second. Preferably the set of increased duty cycle pulses has a duration of more than 5 seconds, and even more preferably a duration of more than 15 seconds. It is also preferable to limit the set of activation pulses with increased duty cycle to less than 10 minutes, and more preferable to limit the second activation waveform to less than three minutes to reduce the likelihood of premature failure of the heaters.

Referring to FIG. 4G, another example embodiment of second activation waveform 102 is shown. In this embodiment, the increased activation component is the baseline voltage applied to the thermal stimulation device. As shown in FIG. 4G, the base line voltage is a constant non-zero voltage waveform which is applied to the heaters. Although this waveform doesn't induce the formation of drops, this electrical activation waveform is useful for cleaning.

FIG. 4H shows another form of this embodiment. The waveform includes activation pulses with a DC offset voltage. The pulses of this waveform induce drop formation with drops having a size similar to that created during the print mode of operation. This waveform also produces an increase of temperature of the immediate surface of the printhead 30 surrounding the nozzle 50, increasing the temperature the fluid ejected from the nozzle and increasing the temperature of the fluid meniscus around the nozzle.

In the example embodiments described above, each set of activation pulses comprised an increase in a single activation component which increased average heater power. It should be recognized that increases to more than one activation component can be incorporated into the set of activation pulses for cleaning. For example, the second activation waveform can comprise an increased pulse frequency and increased pulse amplitude. In other words, multiple activation components can be increased, when compared to the activation components used for a normal printing state, to help improve printhead nozzle cleaning.

Providing the non-printing second activation waveform 102 to the electrical heaters can be useful when removing debris lodged in or near a nozzle. The agitation created by second activation waveform 102 at the location of the debris can dislodge the debris and help to straighten a crooked or otherwise improperly functioning jet.

One advantage of the cleaning technique described above is that the fluid does not need to be turned off during the cleaning cycle. When compared to other cleaning techniques that involve stopping the flow of fluid from the nozzles and then restarting the flow and reestablishing the liquid jets require a significant amount of time, the cleaning technique of the present invention that uses a second activation waveform having an increased activation components can reduce cleaning cycle time. Other advantages of the cleaning technique of the present invention include avoiding the mechanical wear associated with wiping techniques and reducing the ineffectiveness associated with techniques that oscillate or eject cleaning fluids throughout the nozzles themselves without increasing the temperature of the fluid and/or the temperature of the area around the nozzle.

While this cleaning technique can be used when ink is being jetted from the nozzles, it can also be used when other liquids are being jetted from the nozzles, for example, a cleaning fluid having a lower boiling point than the ink normally emitted from the nozzles. These types of cleaning fluids should be resistant to producing coagulation on the nozzle. Furthermore, when specially designed, this type of fluid can amplify the effects of agitating the debris and therefore provide an increased ability to remove debris.

Additionally, the cleaning effectiveness of the second activation waveform can be enhanced by the use of an additional heater internal to the drop generator or in the fluid lines supplying ink to the drop generator to heat the fluid before it reaches the nozzles. Preheating the fluid in this manner can further allow the fluid to agitate, shrink and remove debris from the inside of the orifice base and the area surrounding the ink channel.

As the cleaning technique of the present invention supplies activation pulses to the thermal stimulation device associated with the individual nozzles, the cleaning technique of the present invention can be employed on a nozzle by nozzle basis. For example, the controller 26 can provide the second activation waveform to only the thermal stimulation device associated with a nozzle identified as not functioning properly. Nozzles not functioning properly can include clogged nozzles, partially obstructed nozzles, nozzles producing crooked jets, and nozzles with debris located around the bore. Identification of the improperly functioning nozzle(s) can be achieved using cameras, examination of print samples, or any other method known in the art. Alternatively, the second activation waveform can be applied to one or more thermal stimulation devices on a pre-determined time schedule or upon direction by the user as part of a precautionary or regularly scheduled maintenance or cleaning. Furthermore, in printheads with nozzles having asymmetric heaters, the second activation waveform can be selectively applied only one of the heater segments or a second activation waveform can be applied to one of the heater segments for a period of time followed by applying a second activation waveform to another heater segment associated with the nozzle.

In the example embodiments shown in FIGS. 4E and 4F, the activation pulse frequency is equal to that used during the print mode of operation. The drop size, which varies inversely with the pulse frequency, is approximately equal to the drop size produced in the print mode of operation. Both increased pulse amplitude and increased duty cycle supply the heaters with pulses of increased energy, which causes the breakup of drops from the liquid streams to change. For example, the breakoff length might be decreased by activation pulses of increased energy. The breakoff characteristics might also change in regard to the formation of satellite drops. If this occurs, the drop deflection mechanism can be adjusted accordingly in order to compensate for the breakoff characteristic changes.

In the embodiments described above, the second activation waveform 102 used for cleaning is different from the first activation waveform 100 used for printing. This can cause drop formation that occurs during cleaning to be different from drop formation that occurs during printing. These changes in drop formation can cause the deflection of the drops to be affected. For example, in the embodiment in which the frequency of activation pulses is increased, drops can be produced that are smaller than the drops produced while printing. As smaller drops are more easily deflected by a gas flow drop deflection, these drops can be deflected sufficiently to enter a gas flow duct which can lead to premature printhead failure. To reduce this risk, it is desirable to deactivate or adjust the operation of the drop deflection mechanism while using the second activation waveform for nozzle cleaning in order to reduce the likelihood of excessive drop deflection.

When the frequency of activation pulse is high enough that the activation pulses don't induce drop breakoff, then the liquid stream tends to breakup into drops of random size and the breakoff typically occur at a distance that is farther away from the nozzles (when compared to the distance that breakoff typically occurs during printing). This can result in drops that are not being deflected enough to strike the catcher which can lead to print defects and reduced image quality. To reduce this risk, when using the second activation waveform for cleaning the nozzles, it is desirable to employ a conventional eyelid that seals against the bottom of the catcher and diverts the drops into the fluid return channel of the catcher. Examples of eyelids that are suitable for sealing with the catcher include, but are not limited to, those described in U.S. Pat. No. 4,928,115; U.S. Pat. No. 5,475,410; and U.S. Pat. No. 6,247,781.

The invention has been described in detail with particular reference to certain preferred embodiments thereof, but it will be understood that variations and modifications can be effected within the scope of the invention.

PARTS LIST

20 continuous printer system
22 image source
24 image processing unit
26 mechanism control circuits
28 device
30 printhead
32 recording medium
34 recording medium transport system
36 recording medium transport control system
38 micro-controller
40 reservoir
42 catcher
44 recycling unit
46 pressure regulator
47 channel
48 jetting module
49 nozzle plate
50 plurality of nozzles
51 heater
52 liquid
54 drops
56 drops
57 trajectory
58 drop stream
60 gas flow deflection mechanism
61 positive pressure gas flow structure
62 gas flow
63 negative pressure gas flow structure
64 deflection zone
66 small drop trajectory
68 large drop trajectory
72 first gas flow duct
74 lower wall
76 upper wall
78 second gas flow duct
82 upper wall
86 liquid return duct
88 plate
90 front face
92 positive pressure source
94 negative pressure source
96 wall
100 first activation waveform
102 second activation waveform

The invention claimed is:

1. A method of cleaning a continuous liquid ejection device comprising:

providing a jetting module including an array of nozzles;

providing a thermal stimulation device associated with each nozzle of the array of nozzles;

using a controller in electrical communication with each thermal stimulation device to provide a first activation waveform to each thermal stimulation device; and using the controller to provide a second activation waveform to increase an average power of each thermal stimulation device to clean the associated nozzle with liquid emitted from the associated nozzle, the second activation waveform having a higher activation component, when compared to the first activation waveform, that increases the average power of each thermal stimulation device, wherein the second activation waveform is provided to the thermal stimulation device for a duration of at least one second.

2. The method of claim 1, wherein the first activation waveform provided to each thermal stimulation device creates drops having a first volume and drops having a second volume from liquid emitted from the associated nozzle.

3. The method of claim 2, the liquid ejection device including a gas flow that interacts with the drops having the first volume and the drops having the second volume, the method further comprising:

separating the drops having the first volume from the drops having the second volume to create printing drops and non-printing drops.

4. The method of claim 3, the liquid ejection device including a catcher, the method further comprising:

collecting the non-printing drops with the catcher.

5. The method of claim 4, the catcher including a fluid return channel, the method further comprising:

employing an eyelid to seal against the bottom of the catcher and to divert the liquid of the drops into the fluid return channel of the catcher.

6. The method of claim 1, further comprising:

identifying a clogged nozzle and the thermal stimulation device associated with the clogged nozzle; and using the controller to provide a second activation waveform to only the thermal stimulation device associated with the clogged nozzle to clean the associated nozzle with liquid emitted from the associated nozzle.

7. The method of claim 1 wherein the duration of the second activation waveform is greater than 5 seconds.

8. The method of claim 7 wherein the duration of the second activation waveform is greater than 15 seconds.

9. The method of claim 1 wherein the duration of the second activation waveform is less than 5 seconds.

10. The method of claim 1 wherein the liquid emitted from the nozzle is an ink.

11. The method of claim 1 wherein the liquid emitted from the nozzle is a cleaning fluid having a lower boiling point than an ink normally emitted from the nozzles.

12. A method of cleaning a continuous liquid ejection device comprising:

providing a jetting module including an array of nozzles;

providing a thermal stimulation device associated with each nozzle of the array of nozzles;

using a controller in electrical communication with each thermal stimulation device to provide a first activation waveform to each thermal stimulation device;

using the controller to provide a second activation waveform to increase an average power of each thermal stimulation device to clean the associated nozzle with liquid emitted from the associated nozzle, the second activation waveform having a higher activation component, when compared to the first activation waveform, that increases the average power of each thermal stimulation device;

identifying a clogged nozzle and the thermal stimulation device associated with the clogged nozzle; and using the controller to provide the second activation waveform to only the thermal stimulation device associated with the clogged nozzle to clean the associated nozzle with liquid emitted from the associated nozzle.

13. A method of cleaning a continuous liquid ejection device comprising:

providing a jetting module including an array of nozzles;

providing a thermal stimulation device associated with each nozzle of the array of nozzles;

using a controller in electrical communication with each thermal stimulation device to provide a first activation waveform to each thermal stimulation device; and using the controller to provide a second activation waveform to increase an average power of each thermal stimulation device to clean the associated nozzle with liquid emitted from the associated nozzle, the second activation waveform having a higher activation component, when compared to the first activation waveform, that increases the average power of each thermal stimulation device, wherein the liquid emitted from the nozzle is a cleaning fluid having a lower boiling point than an ink normally emitted from the nozzles.

* * * * *